United States Patent [19]

Hogstrom

[11] Patent Number: 4,850,277

[45] Date of Patent: Jul. 25, 1989

[54] TREADLE ASSEMBLY FOR THROWING ARMOR PIERCING CHARGES

[76] Inventor: Harold R. Hogstrom, 3219 Stockton Pl., Holland, Pa. 18966

[21] Appl. No.: 190,406

[22] Filed: May 5, 1988

[51] Int. Cl.[4] ..... F42B 23/04

[52] U.S. Cl. ..... 102/404; 102/401

[58] Field of Search ..... 102/401, 404, 424, 428

[56] References Cited

U.S. PATENT DOCUMENTS

| | | | |
|---|---|---|---|
| 3,216,354 | 11/1965 | Bearce | 102/401 |
| 3,304,864 | 2/1967 | Thomanek | 102/427 |
| 3,495,532 | 2/1970 | Roberts et al. | 102/404 |
| 4,122,775 | 10/1978 | Held | 102/401 |
| 4,252,062 | 2/1981 | Auge | 102/401 |
| 4,402,271 | 9/1983 | Heidmann et al. | 102/401 |

*Primary Examiner*—Charles T. Jordan
*Attorney, Agent, or Firm*—John J. Simkanich

[57] ABSTRACT

A treadle assembly for throwing armor piercing shaped charges or squash charges against the underside of armored vehicles has a tripping batten connected at an angle or cant to a lever arm or leg which leg holds an armor-penetrating munition on its far end. The batten and lever arm structure is such so that the munition is oriented in the correct direction when the assembly is deployed on the surface of the ground, such as a field or roadway. The munition has a firing pin which, when armed, extends upwardly to contact the underside of the armored vehicle when the vehicle wheel or tread pushes over the treadle plate thereby pivoting the lever arm and raising the munition.

11 Claims, 4 Drawing Sheets

TREADLE ASSEMBLY FOR THROWING ARMOR PIERCING CHARGES

BACKGROUND OF THE INVENTION

This invention relates to the field of armaments and particularly to mechanical triggers, catapults, petards and other structures for positioning and moving or triggering explosive charges.

A number of attempts have been made to adapt the "shaped-charge" and the "high explosive plastic" or "squash-charge", which are manufactured in large numbers and readily available, to the requirements of an anti-tank device. These shaped-charge designs have been directed at the tasks of (a) disabling the vehicle's running gear U.S. Pat. No. 3,216,354; U.S. Pat. No. 4,252,062, (b) penetrating one of the sides of the tank U.S. Pat. No. 3,304,864; U.S. Pat. No. 4,402,271 or (c) penetrating the floor of the tank as it passes over the mine U.S. Pat. No. 3,495,532; U.S. Pat. No. 4,122,775.

Bearce, U.S. Pat. No. 3,216,354, shows a land mine having a spring biased firing pin which is retracted when disarmed and extends upwardly/outwardly when armed. The mine, which is pie-shaped, is intended to be buried and explodes with a shaped charge when the firing pin is depressed.

The triggering of the firing pin occurs when an armored vehicle or other vehicle runs/rolls over the firing pin. Auge, U.S. Pat. No. 4,252,062 likewise shows a shaped charge mine directed to limiting the direction of the explosive force of the mine. The Auge mine has a spring loaded extendable firing pin which when armed (extended), explodes the charge by impacting the detonator. These devices are designed to be buried below the surface of the ground.

Thomanek, U.S. Pat. No. 3,304,864 shows an above ground structure having spaced electrified rods forming the closing switch for firing a shell from an above-ground tank belt-line height launcher.

Heidmann, et. al., U.S. Pat. No. 4,402,271, shows an anti-tank mine which is an armor piercing shell fired from an above-ground launcher, this launcher being capable of being pivoted into one of four firing positions usually spaced 90 degrees apart, by the tripping of one of four detector cables which act as a location detector and a guidance means when the tread of the tank snags a particular cable.

Both of these devices require above-ground apparatus and sophisticated, time-consuming deployment.

Roberts, et al., U.S. Pat. No. 3,459,532 and Held, U.S. Pat. No. 4,122,775, each show buried mines with proximity detectors. The Roberts device uses a pressure sensitive detonator positioned just beneath the ground surface to detonate a shaped charge or to detonate a shell buried further below the surface.

The Held device is a firing mechanism for a buried charge. This firing mechanism involves a delicately balanced vibration detector.

To deploy the Roberts and the Held devices very skilled personnel and ample time are required.

Many other types of mines have also been patented. These have been directed to various shaped charge designs, various spring biased detonator designs and various pressure and proximity detectors.

Those prior art designs which employ the shaped-charge and the squash-charge in mines which are otherwise of conventional design achieve a marginal improvement over standard anti-tank mines, but they are unlikely to do more than immobilize vehicles. Designs which are aimed at applying the shaped and squash-charge to the sides of the tank require uncertain means of activation such as electrical tripping, wire tracks and guidance devices. Moreover, since modern tanks are improving their belt armor through such means as lamination, reactivity, and spent uranium mesh reinforcement precisely in order to defeat munitions such as these, mines employed in this manner are of dubious value. Those designs discussed above which endeavor to defeat an armored vehicle by penetrating its relatively thin underside either fail to place the explosive charge at the optimal distance from the tank's floor plate or they require careful and time-consuming implantation, a firing mechanism of some delicacy and a projection apparatus. The implantation of such devices is a laborious and lengthy task. A rapidly changing, modern battlefield would seldom afford the leisure time necessary to effectuate such a defense. The labor-intensive efforts necessary in laying such a field would require the assembly of sizeable bodies of engineers who would both present an inviting target and reveal the fact that a defense was being prepared.

What is desired is a simple yet effective mine activator assembly which can be easily and quickly deployed and which is reliable in its design. What is also desired is an activator assembly which, when tripped by a tank, inerrably places its munition in a position impingent against the underside of a tank or armored vehicle.

SUMMARY OF THE INVENTION

A treadle assembly for positioning an armor piercing charge against the underside of an armored vehicle for detonation is provided. This assembly includes a tripping mechanism which acts like a treadle plate or tripping batten.

Attached to this batten in such a way as to hold the batten at a angle with the ground, is one or more elongated arms or poles. Positioned at and attached to the free end of each arm or pole is a shaped charge or squash charge with a protrusible firing pin. One charge member is attached to the free end of each individual pole. This attachment of the explosive member to the pole is likewise at an angle so that when the pole and its explosive member are pivoted upwardly into contact with the underside of a vehicle, the propinquity of the explosive member will be such as to activate the firing pin while the explosive member is positioned to exert its maximum capacity for penetration.

Pivoting occurs when a tire or tread of a vehicle rolls over the batten causing the treadle reaction of raising the pole and charge so that it will act as a petard-like structure and thrust the charge against the undercarriage of the vehicle.

The assembly invention is deployed by strewing a plurality of the devices on the ground surface in irregular rows or successions of such rows, with the charges armed. The deployment is with poles extending essentially horizontally from the batten end and aimed in the direction from which attacking vehicles are expected to come.

Each treadle batten may have one or more poles attached, such as having two poles spaced apart somewhat less than the width of the armored vehicle which it is intended to act against. While the wheel or tread of the vehicle might detonate the explosive charge by rolling over its firing pin, the statistically more likely act would be that the tread would tip the batten and raise the charge against its underside. The pole would thereby act as a pivoting petard or lever.

DESCRIPTION OF THE DRAWINGS

This treadle petard-type mine invention can better be understood regarding its structural features, advantages and operation from a reading of the following detailed description of the invention with the accompanying drawings in which like numerals refer to like elements, and where.

DETAILED DESCRIPTION OF THE INVENTION

The invention described below is intended to disable an armored vehicle by penetrating its "belly" armor and accomplish this with a mine of such simplicity that the likelihood of its failing would be minimal. It incorporates a tripping/activation and placement structure which requires minimal care and minimal time and effort in deployment, is light in weight, and is sufficiently low in cost so that it could be deployed economically in very large numbers. The invention gives each mine the ability to act against a vehicle passing over a swathe of defended ground more than twice the width of a typical main battle tank.

This invention would provide a device which acts against an armored vehicle as a result of the movement of the vehicle passing over it, such movement pushing over a treadle plate and thrusting a petard attached to the plate against the undercarriage of the vehicle with sufficient force to ignite a fuse in the attached munition.

When the mine employed is a shaped-charge, a firing pin extending upwardly from the top face of the mine would cause the charge to explode at the optimal distance from the vehicle's belly plating. When used with a squash charge, the petard would be fused to explode upon impinging against the belly armor. Since the pivoting of the petard would be effected by the mechanical energy derived from the movement of the vehicle against the tripping plate, a more costly and complex means for projecting the explosive against the vehicle is unnecessary.

The framework to which the mine would be attached and which would serve to thrust the mine upward is designed to be deployed on the surface of the ground. In practice it would be customary to conceal each device under a dusting of soil or snow or a swatch of camouflaging material except in the event that deployment took place in an area with ground-covering vegetation where concealment would be unnecessary. Deployment would be such a simple matter that it could be done very quickly and easily. Since the part of the framework would be made of wood and plastic, or of non-ferrous metals, the device would be light and cheap, and since its elements would be of low mass and density, it would not be easily detected by sweeping devices. Since it would lie almost flat upon the ground, producing a low profile, it would be difficult to perceive from a moving vehicle. The configuration of the device would give it the ability to perform its function across a channel at least twice the width of an average main battle tank.

Figure 1:
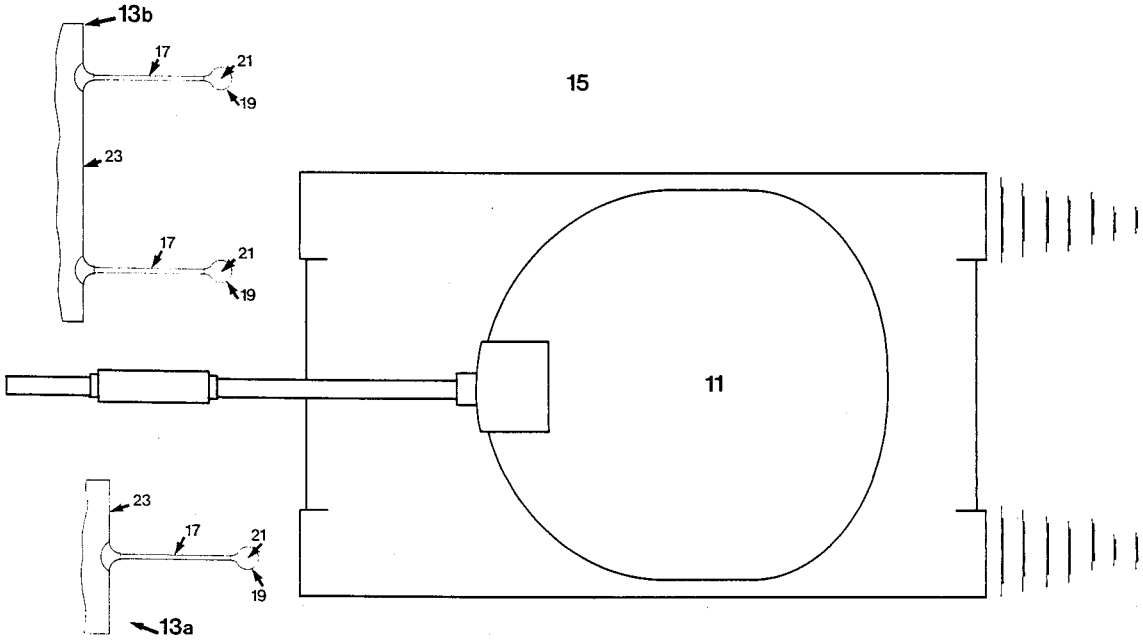
FIG. 1 is a plan view of a tank advancing on a line of deployed treadle petard-type mine assemblies being deployed on the ground surface with or without ground camouflage.

Referring to FIG. 1, an armored vehicle or tank 11 is shown approaching a line of treadle assemblies **13*a* and 13*b* which are deployed in a parallel manner on the ground surface 15. The single lever arm 17 treadle assembly 13*a* placed ahead of the double lever arm 17 assembly will come into contact first with the charging tank 11. If the tank 11 tread rolls over the mine 19 at the end of the arm 17 of the assembly 13a and depresses the protruding firing pin 21 the munition 19** will explode. This will rupture the tread of the vehicle in the same manner as a conventional mine.

If the tread of the tank 11 is not ruptured by this explosion, the tank 11 will next come into contact with the tripping batten 23 of the other assembly **13*b* thereby pressing it flat to the ground. As the tank 11 passes over this double lever arm 17, treadle assembly 13*b* and the lever arm 17 is pivoted upwardly, raising the munition 19 into proximity with the undercarriage of the tank 11. If it is a shaped charge, it explodes at the optimal distance from the undercarriage. If it is a squash charge it explodes when in direct contact with the undercarriage of the tank 11**.

The munition 19 is available from various manufacturers, one of which is Atiebolaget Bofors, of Bofors, Sweden, model Carl Gustave. American suppliers include General Electric, Burlington, Vermont; Olin Corporation, Marion, Illinois; Dyna East Corporation of Philadelphia, Pennsylvania; and Minneapolis-Honeywell Corporation, Minneapolis, Minnesota. Munitions manufactured by these concerns are adaptable to the invention. Many of these devices are sufficiently powerful to penetrate the tank underbelly with less than approximately 2 kilograms of explosive. Other munitions, with more powerful plastic explosives may weigh even less. The entire invention assembly should weigh no more than about 8 kilograms.

Figure 2:
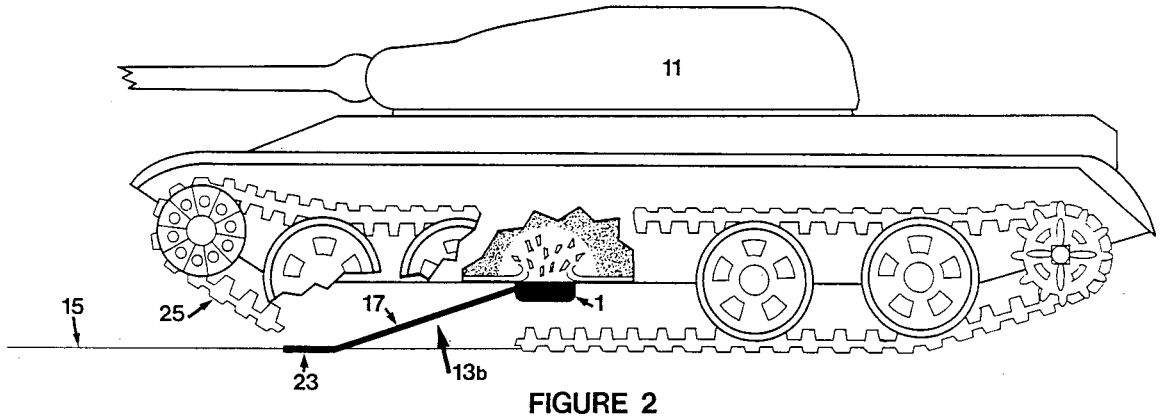
FIG. 2 shows a partial sectional side view of the advancing tank activating the assembly to pivot the explosive member against the underbody of the tank.

Referring to FIG. 2, the tripping batten 23 of the treadle assembly **13*b* is pressed flat to the ground 15 by the pressure of the track 25 of the tank passing over it. The tripping batten 23 is pushed flat to the ground 15 and the lever arm 17 being offset from the face of batten 23 is pivoted upwardly. The attached mine 19 is raised and is shown rupturing the underside of the tank 11 as a result of impacting with the underside of the tank 11 and activating the firing pin 21. The tank 11** is thereby disabled.

Figure 3:
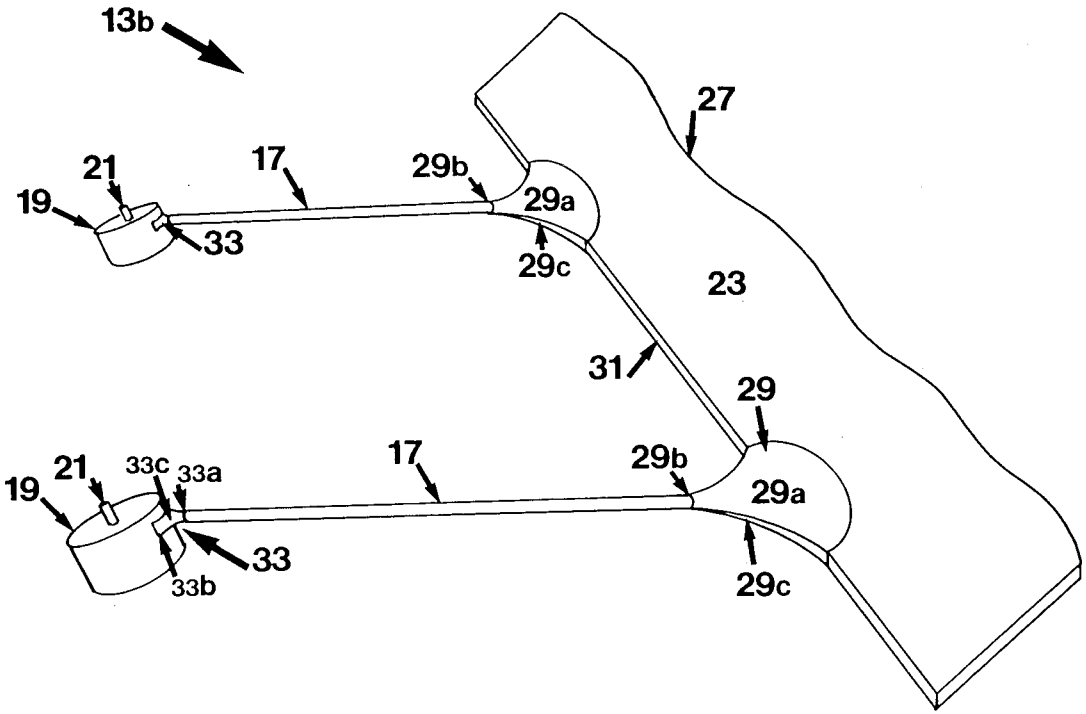
FIG. 3 shows a perspective view of a double petard pole batten assembly.

The treadle plate or batten 23 of a typical assembly **13*b*, FIG. 3, can be made from a plank or beam of wood or plastic and can be rectangular in shape with all straight edges except for its upper edge which might be irregular in order to lend itself more readily to camouflage and concealment. This treadle plate or batten 23** can be made to any size, but is most easily handled manually when it is between 1 meter and 3 meters in length.

For use against tank 11, this batten 23 can be between 25 centimeters and 40 centimeters wide and between 2 centimeters and 4 centimeters in thickness.

The lever arm 17 is implemented as a solid pole or a hollow tube or pipe. This lever arm (pole) 17 is straight and extends outwardly from the batten 23 a distance of from 60 centimeters to 2 meters. The length of this pole 17 which forms a leg of the assembly **13*b* is of sufficient length to impact the belly of the tank at a point beyond its comparatively thick forward armor. This distance can be adjusted by changing the length of the pole 17** to overcome counter-measures that might be employed to deal with lever arms of uniform length.

A bracket 29 has a flat surface **29*a* for mating to the bottom edge 31 face area of the treadle plate 23. The bracket 29 is shaped with a tubular socket 29*b* to receive an end of the pole 17**.

The bracket 29 has a bend or angle **29*c* created between its flat surface 29*a* and its tubular socket 29*b*. This angle 29*c* is responsible for holding the leg (pole) 17 at a obtuse angle of about 120 to 150 degrees from the face of the batten 23**.

The munition 19 is of a type available in the marketplace from a variety of munitions manufacturers. This munition 19 discussed further below has a cylindrical shape with a central protrusible firing pin 21 which when depressed into the mine body 19 activates the explosion.

A second bracket 33 holds the munition 19 to the other or free end of the pole 17.

This bracket 33 has a tubular socket **33*a* for receiving the free end of the pole 17. The bracket 33 fans outwardly from this socket 33*a* to form an arc-shaped plate portion 33*b* which is attached to the round side structure of the munition 19**.

This bracket 33 likewise has a bend **33*c* to allow the munition 19 to be canted at an angle from the longitudinal axis of the pole 17**.

This second bracket angle **33*c* can differ from the first bracket angle 29*c* or it can be the same. The purpose in these two angles 29*c* and 33*c* is to position the firing pin 21 properly against the undercarriage of a tank 11**.

In operation the pole 17 pivots to thrust the munition 19 against a tank 11 as in the classical "petard" operation.

Figure 4:
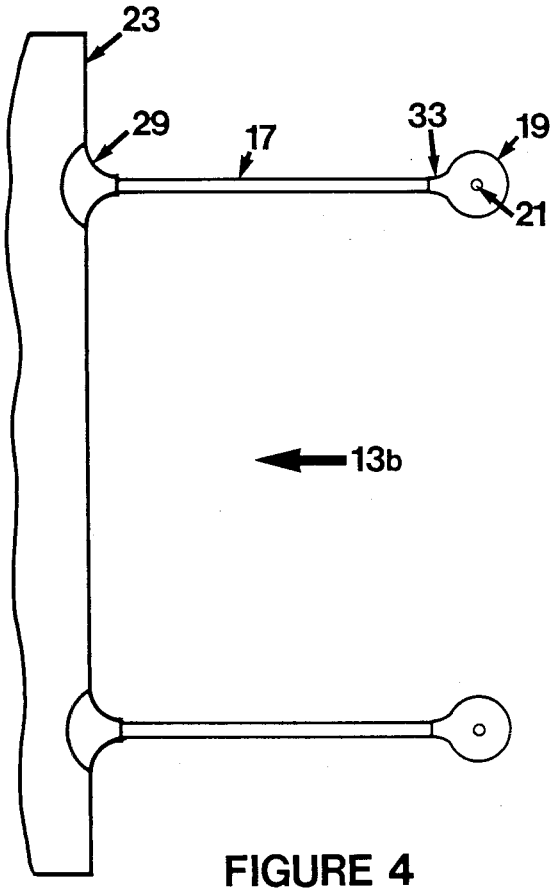
FIG. 4 shows a top or plan view of the assembly of FIG. 3.
Figure 5:
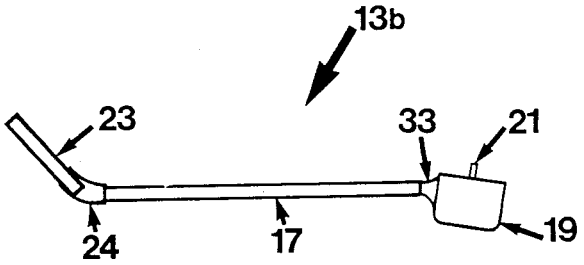
FIG. 5 shows a side view of the assembly of FIG. 4.

FIG. 4 and 5 show a top or plan view and a side elevation view, respectively, of the double "petard" embodiment.

The attachments of the various components 17, 19, 23, 29, 33 of the assembly will depend upon the materials used for these components 17, 19, 23, 29, 33. Attachment can be by pinning, bolting, riveting, gluing, epoxying, soldering, brazing or other means.

The invention can be deployed in straight successive rows across a line of advance, or in skewed rows or in other fashion.

The tripping batten can be made of wood, plastic and/or any non-metallic material to which the bracket 29 can be attached. The material used to make the tripping batten 23 can be made with a metallic element, but such use would lend to easy detection by a metal detection device.

The part of the batten 23 which is placed flush upon the ground is cut or made to lay flat or even with the ground. The portion of the batten 23 which ideally comes into contact with the track 25 of the tank 11 is preferably at an angle to the ground when deployed.

The length of the batten 23 can be adjusted to a maximum of somewhat less than the width of an average armored vehicle. The thickness of the batten 23 should be sufficient to provide the strength not to break or shatter under the force of the tread or the impact necessary to detonate the munition 19.

As an alternative to the above, variations can be made to the structure and still be within the scope of the invention. The pole 17 can also be made flat and can include an offset, eliminating the need for the bracket 33 bend 33C. For example, if the batten 23 is placed at an 90° angle to the ground, the pole 17 could be straight; if the batten 23 is placed at an angle greater than 90° with the ground, the lever or pole 17 would be offset to the batten 23, so that optimal striking distance from the tank is achieved.

As to any alternative designs of structure or materials, the lever or pole 17 should be of sufficient width or strength to enable it to hold a charge element at one end until such time as it strikes the underside of the tank 11 and detonates. It should be of a material which would lend itself to secure attachment to both ends of the assembly.

Figure 6:
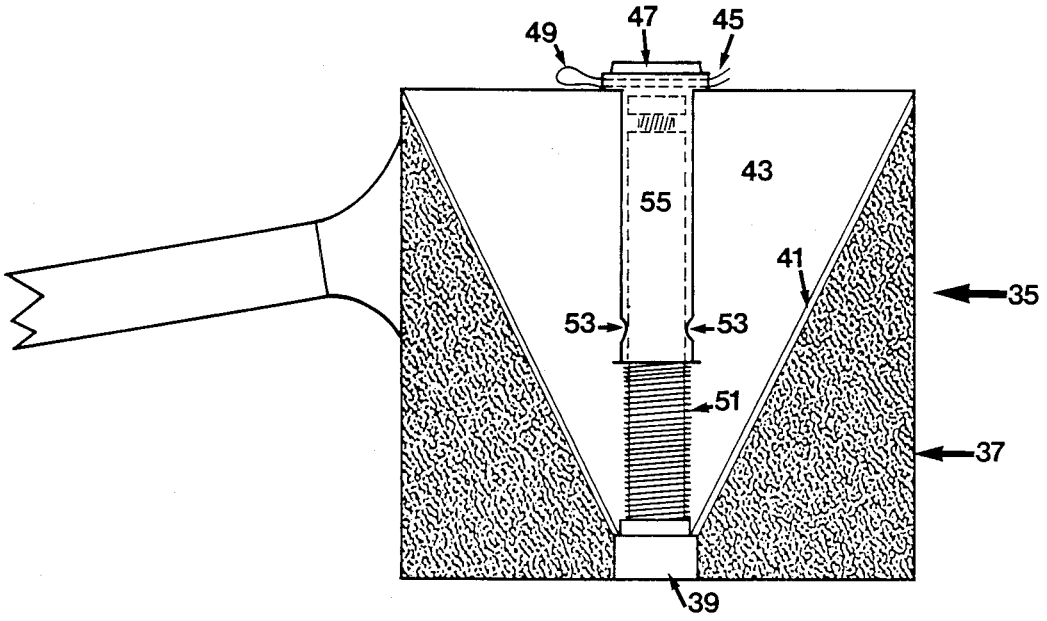
FIG. 6 shows a partial sectional view taken as shown in FIG. 4 of the explosive member mounted on a petard pole.
Figure 7:
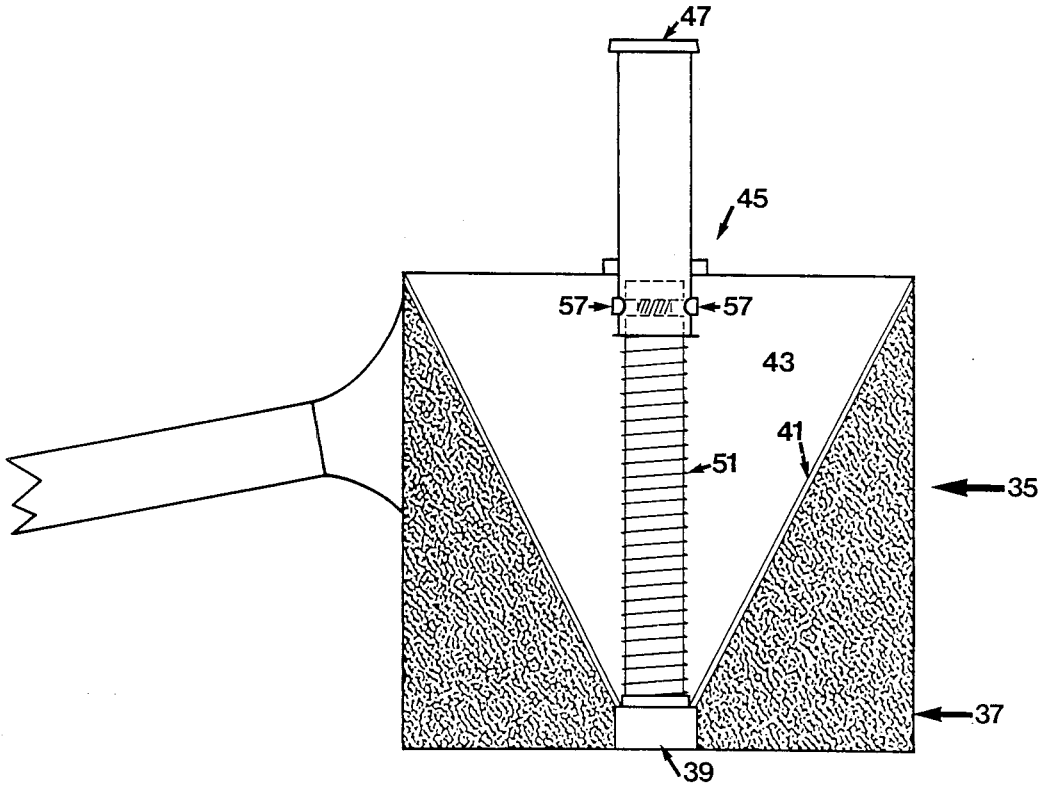
FIG. 7 shows the same explosive member of FIG. 6 with its firing pin extended in the armed state.

The munition 19 containing the shaped charge 37, FIGS. 6 and 7, the primer 39, the cone shaped copper liner 41, the retracting firing column 47, 55 and the compressed spring 51 is of a type that is commercially available from Atiebolaget Bofors and others as stated above.

As the charge 41 is intended to explode a short distance from the underbelly of the tank 11, the firing pin 47 extends outwardly a distance when armed (FIG. 7) so that the pin 47 movement necessary to cause an explosion occurs when contact is made upon the pin end 47.

The above description is intended to be illustrative of the invention and is not intended to be read as limiting the invention. Many changes can be made in the invention without departing from the intent and scope thereof.

What is claimed is:

1. A surface land mine treadle activation assembly, comprising:

a treadle plate positionable at an acute angle from the horizontal;

at least one leg attached to the treadle plate at an obtuse angle; and an explosive device attached to the free end of each said leg at an acute angle, wherein this explosive device includes a triggering pin upwardly standing.

2. The assembly of claim 1 wherein each said treadle plate has two legs attached thereto on the same side thereof and extending outwardly from said treadle plate, and wherein each said leg has attached at the free end thereof an explosive device having a triggering pin upwardly standing.

3. The assembly of claim 1 wherein each said treadle plate has a plurality of legs attached thereto on the upwardly facing side thereof each said leg extending outwardly from said treadle plate and having an explosive device attached to the free end thereof.

4. The assembly of claim 3 wherein said plurality of legs extending outwardly from said treadle plate, extend parallel to one another.

5. The assembly of claim 4 wherein said plurality of parallel extending legs each extend perpendicularly to the longitudinal axis of said treadle plate.

6. The assembly of claim 5 wherein each said explosive device is a shaped charge and wherein said shaped charge has a retracted firing pin which can be extended outwardly and upwardly when said charge is approximately horizontal.

7. The assembly of claim 6 wherein each said shaped charge mounted on a said respective leg is mounted at an obtuse angle from the horizontal and wherein each said leg meets said treadle plate at an obtuse angle with respect to said treadle plate acute angle.

8. The assembly of claim 7 wherein said treadle plate acute angle being measured from the horizontal is between 30 degrees and 60 degrees and where said shaped charge obtuse angle forms the supplemental angle to said treadle plate acute angle.

9. The assembly of claim 8 wherein said treadle plate is between approximately 1 meter and approximately 3 meters long, between approximately 25 centimeters and approximately 40 centimeters wide and between approximately 2 centimeters and approximately 4 centimeters thick.

10. The assembly of claim 9 wherein each said leg is a pole having an outside diameter between approximately 2.5 centimeters and approximately 4 centimeters and also including an individual bracket for mounting each said pole to said treadle plate.

11. The assembly of claim 10 wherein said poles are spaced apart from approximately 1 meter to approximately 3 meters.

* * * * *